US007983604B2

(12) United States Patent
Brown et al.

(10) Patent No.: US 7,983,604 B2
(45) Date of Patent: Jul. 19, 2011

(54) MAGNETIC SCAVENGER FOR AN ELECTROSTATOGRAPHIC PRINTER

(75) Inventors: Kenneth J. Brown, Penfield, NY (US); Eric C. Stelter, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 725 days.

(21) Appl. No.: 11/945,497

(22) Filed: Nov. 27, 2007

(65) Prior Publication Data

US 2009/0136267 A1 May 28, 2009

(51) Int. Cl.
*G03G 15/095* (2006.01)
*G03G 15/09* (2006.01)

(52) U.S. Cl. ..... 399/264; 399/267

(58) Field of Classification Search ..... 399/264, 399/267, 271
See application file for complete search history.

(56) References Cited

U.S. PATENT DOCUMENTS 5,047,807 A * 9/1991 Kalyandurg ..... 399/264
5,260,159 A 11/1993 Ohtani et al.
5,570,170 A 10/1996 Muranyi et al.

* cited by examiner

*Primary Examiner* — William J Royer
(74) *Attorney, Agent, or Firm* — Donna P. Suchy

(57) ABSTRACT

An apparatus and method for managing magnetic carrier in an electrostatographic printer including an apparatus for directing magnetic carrier from a photoconductor, back toward a feed apparatus wherein the apparatus includes a magnetic carrier scavenger such that there is more magnetic carrier volume in the direction of the feed apparatus as well as a well to collect any magnetic carrier that does not move toward the feed apparatus.

10 Claims, 9 Drawing Sheets

S

MAGNETIC SCAVENGER FOR AN ELECTROSTATOGRAPHIC PRINTER

FIELD OF THE INVENTION

The invention relates to electrographic printers and apparatus thereof More specifically, the invention is directed to an apparatus and method for scavenging magnetic particles in an electrostatographic printer.

BACKGROUND OF THE INVENTION

Electrographic printers and copiers utilizing developer comprising toner, carrier, and other components use a developer mixing apparatus and related processes for mixing the developer and toner used during the printing process. The term "electrographic printer," is intended to encompass electrophotographic printers and copiers that employ dry toner developed on an electrophotographic receiver element, as well as ionographic printers and copiers that do not rely upon an electrophotographic receiver. The electrographic apparatus often incorporates an electromagnetic brush station or similar development station, to develop the toner to a substrate (an imaging/photoconductive member bearing a latent image), after which the applied toner is transferred onto a sheet and fused thereon.

A toner image may be formed on a photoconductor by the sequential steps of uniformly charging a surface of the photoconductor in a charging station using a corona charger, exposing the charged photoconductor to a pattern of light in an exposure station to form a latent electrostatic image, and toning the latent electrostatic image in a development station to form a toner image on the photoconductor surface. The toner image may then be transferred in a transfer station directly to a receiver, e.g., a paper sheet, or it may first be transferred to an intermediate transfer member or ITM and subsequently transferred to the receiver. The toned receiver is then moved to a fusing station where the toner image is fused to the receiver by heat and/or pressure.

In electrostatographic copiers and printers, pigmented thermoplastic particles, commonly known as "toner," are applied to latent electrostatic images to render such images visible. Often, the toner particles are mixed with and carried by somewhat larger particles of magnetic material. During the mixing process, the magnetic carrier particles serve to triboelectrically charge the toner particles to a polarity opposite that of the latent electrostatic image. In use, a developer mix is advanced, typically by magnetic forces, from a sump to a position in which it contacts the latent electrostatic image.

The relatively strong electrostatic forces associated with the latent electrostatic image operate to strip the toner from the carrier, causing the toner to remain with the latent electrostatic image. Thus, it will be appreciated that, as multiple latent electrostatic images are developed in this manner, toner particles are continuously depleted from the developer mix and a fresh supply of toner must be dispensed from time-to-time in order to maintain a desired image density. Usually, the fresh toner is supplied from a toner supply bottle mounted upside-down, i.e., with its mouth facing downward, at one end of an image-development apparatus. Under the force of gravity, toner accumulates at the bottle mouth, and a metering device, positioned adjacent the bottle mouth, operates to meter sufficient toner to the developer mix to compensate for the toner lost as a result of image development. Usually, the metering device operates under the control of a toner concentration monitor that continuously senses the ratio of toner to carrier particles in the developer mix.

Development stations require replenishment of toner into a developer sump to replace toner that is deposited on the photoconductor or receiver as well as a magnetic carrier that are mixed together uniformly to form an effective developer. The developer must be mixed and transported to a position where it can be in contact with the latent electrostatic image. If the photoconductor picks up too much magnetic carrier the printing process is compromised. This can lead to many problems from poor prints to no prints at all as well as a depletion of magnetic carrier to a point where an image is not effectively formed. As a feed apparatus picks up developer from a feed roller the amount of developer left near the rear portion of the feed roller is greatly decreased to the point where there is no developer left to transport to the latent electrostatic image and printing stops. This is not an easy problem to solve since a simple change in developer amount or charge can quickly change conditions near the photoconductor. This problem is enhanced when there is less developer left in a feed channel, then a pick-up point becomes even further from the feed roller, and since the magnetic force is decreased by multiples as the distance decreases, this makes the problem quite significant. This appears to become enhanced and complicated at higher print speeds.

The present invention corrects the problem of magnetic carrier transport from the photoconductor surface back to the development station. For example with a two-component development system, marking media (dry ink) is electrostatically adhered to magnetic particles of ferrite (carrier) in the development station. The toner, such as dry ink, is deposited to image areas on the photoconductor, while the carrier returns to the development station, where it can then be repopulated with dry ink to continue the electrophotographic cycle. During the development process, carrier can also deposit on the photoconductor surface, and cannot return to the development station without some intervention. The apparatus and related methods described allow the printer to produce the high quality prints or powder coatings required by consumer demand by removing magnetic carrier in areas on the photoconductor that will interfere with the image formation and operation of the printer.

SUMMARY OF THE INVENTION

The invention is in the field of mixing apparatus and processes for electrographic printers. More specifically, the invention relates to an apparatus and method for managing magnetic carrier in an electrostatographic printer including an apparatus for directing magnetic carrier from the photoconductor, back toward the feed apparatus wherein the apparatus includes a magnetic carrier scavenger such that there is more magnetic carrier volume in the direction of the feed apparatus as well as a well to collect any magnetic carrier that does not move toward the feed apparatus.

DETAILED DESCRIPTION OF THE INVENTION

Figure 1:
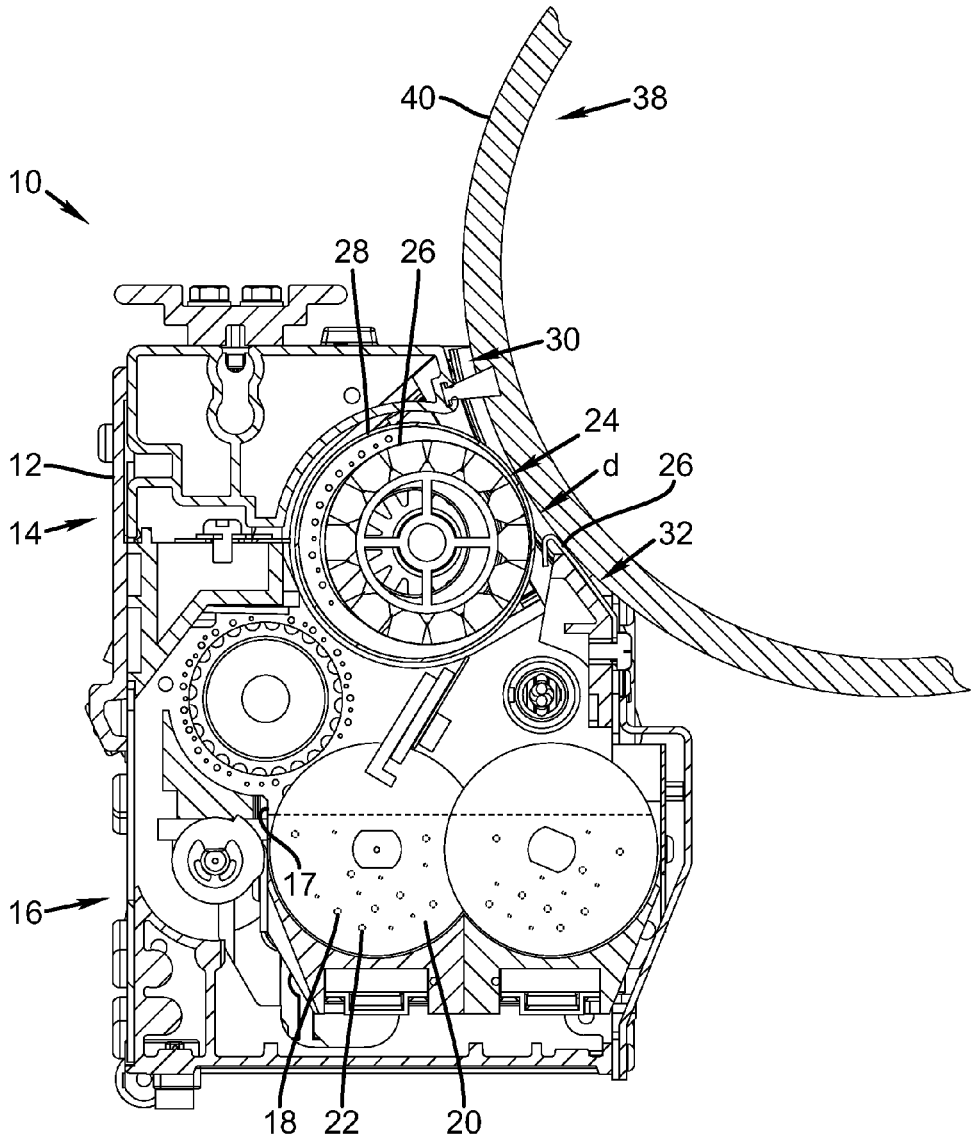
FIG. 1 is a side elevational view, in cross-section, of a reproduction apparatus magnetic brush development station according to this invention.

FIG. 1 shows an electrostatic printer magnetic brush development station, according to this invention, sometimes simply referred to as a development station, designated generally by the numeral 10. A development station housing 12 encloses a feed apparatus 14 and a powder conveyance device 16 and forms, in part, a reservoir 17 for developer material 18 comprising a powder 20 and a magnetic carrier material 22, hereafter referred to as magnetic carrier 22. The magnetic carrier 22 is described as a powder and could include one or more of both magnetic carrier and/or magnetized toner including pigments toner as well as any other material that is influenced by an electric and/or magnetic field. The development roller 24, also referred to as a toning roller 24, is mounted within the development station housing 12. The development roller 24 includes a core magnet 26 shown in FIG. 1 as a fourteen-pole core rotating core magnet rotating counterclockwise inside a rotating shell 28 (shown as rotating clockwise in FIG. 1) delivers a required quantity of developer material, including the powder 20 and the magnetic carrier 22, from the reservoir 17 to a development zone 30. The core magnet 26 and the shell 28 can have many other suitable relative rotations as is known in the art.

Figure 2:
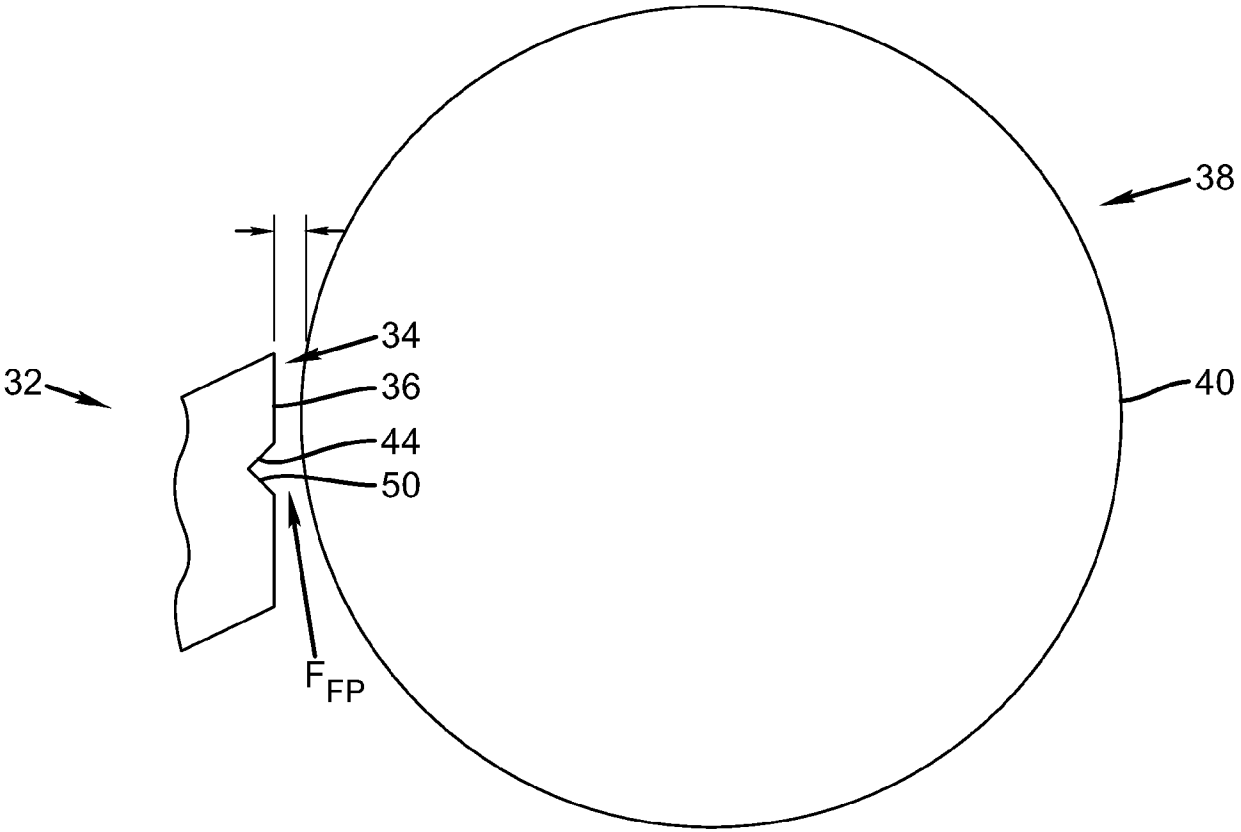
FIG. 2 is an end view, partly in cross-section and on an enlarged scale, of a development roller and scavenger plate of the magnetic brush development station of FIG. 1.

A magnetic carrier control device 32, as shown in FIG. 2, includes a scavenger plate 34 with a faceplate 36 that creates an electric field $F_{FP}$ between a photoconductor 38, and specifically a photoconductor surface 40, and the faceplate 36 to preferentially direct magnetic carrier 22 from the photoconductor 38 back toward the feed apparatus 14. The photoconductor 38 also referred to as an imaging cylinder 38, is next to a blanket cylinder used for transferring the image to a receiver S. A support plate 58 supports the faceplate 36 such that the support plate 58 does not influence the electric field $F_{FP}$ between the photoconductor surface 40 and the faceplate 36 and one or more troughs 44 adjacent the faceplate 36, also known as the face 36, such that scavenged magnetic carrier 22 is collected and retained away from the photoconductor 38. The faceplate 36 of the scavenger plate 34 is positioned parallel to the longitudinal axis of the development roller 24 and the photoconductor surface 40, at a location upstream in the direction of shell rotation prior to the development zone 30. The scavenger plate 34 extends the length of the development roller 24 (see FIG. 3). The lower plate is positioned a distance from the photoconductor surface 40 so that there is no effect from the photoconductor surface 40. The core magnet 26 does not extend the entire length of the development roller 24; as such, the developer nap on the shell 28 does not extend to the end of the development roller 24.

FIG. 2 also shows the lower plate 44 and one or more troughs 50 adjacent the faceplate 36 such that the majority of the surplus magnetic carrier 22 is collected and returned to the development station 10 by the influence of the magnetic field created by the development roller 24. This magnetic debris can be removed manually and/or automatically via devices including a magnetic pencil and/or a vacuum or other appropriate devices or method. The development station 10 houses one or more development rollers 24 to move the developer material within the reservoir 17 of the housing 12 from a mixing area to the feed apparatus 14. The core magnet or permanent magnet 26, in one embodiment, is a single pole permanent ceramic magnet 26, provides a magnetic field with a strength in the range of 400 to 1200 gauss, and preferably 900 gauss. One end of the core magnet 26 is approximately flush with the end of the development roller 24 and extends along the longitudinal axis of the development roller 24 such that an overlap (approximately 10 mm) exists with the development roller 24. The magnetic carrier control device 32 is secured proximate the underside of a photoconductor 38 by a mount that secures the scavenger plate 34 using a fastener putting the face 36 of the magnetic carrier control device 32 in close proximity to the photoconductor surface 40.

To further prevent development material from escaping from the development station housing 12, there is provided an easily serviced assembly for the scavenger plate 34. This assembly is robust to wear and any heat generation. Two bearings with a spacer in between are used so as to maintain minimum radial movement. A washer and e-rings complete the assembly and hold it together, and can be removed by disassembling any drive mechanism, and then removing the assembly.

It should be noted that, as the reproduction apparatus market has evolved from black and white copiers to process color printers, more development stations needed to be fit into essentially the same amount of machine space. To do this a more compact station was needed that would still adequately mix developer material and hold as large a developer material volume as possible. The increased station capacity was desired to increase the time between developer material replenishment and changes. Also, the larger volume of developer material would allow for higher takeout rates of marking particles while removing a smaller percentage of the available particles. The magnetic brush development station 10, according to this invention, provides for replenishing the reservoir 17 with a supply of magnetic carrier 22 that is returned to the development station 10 from places on and near the photoconductor 38. This allows the marking particles to be mixed into the developer material much quicker and can subsequently get triboelectrically charged much quicker and cuts down in the amount of magnetic carrier that must be purchased and used to supplement the developer. This aids in reducing dusting and maintaining a uniform concentration of marking particles throughout the sump.

The magnetic carrier control device 32 has a set spacing from the faceplate 36 to the photoconductor surface 40 because the effectiveness of the magnetic carrier control device 32 is sensitive to the spacing between the magnetic carrier control device 32 and the photoconductor surface 40 such that, in this arrangement, the effectiveness of the magnetic carrier control device 32 decreases with increased spacing from the photoconductor surface 40. If the magnetic carrier 22 on the face of the magnetic carrier control device 32 cannot be returned to the development station 10, this can result in contamination of other areas of the electrophotographic reproduction apparatus, such as the photoconductor 38 and other areas in the apparatus.

Figure 3:
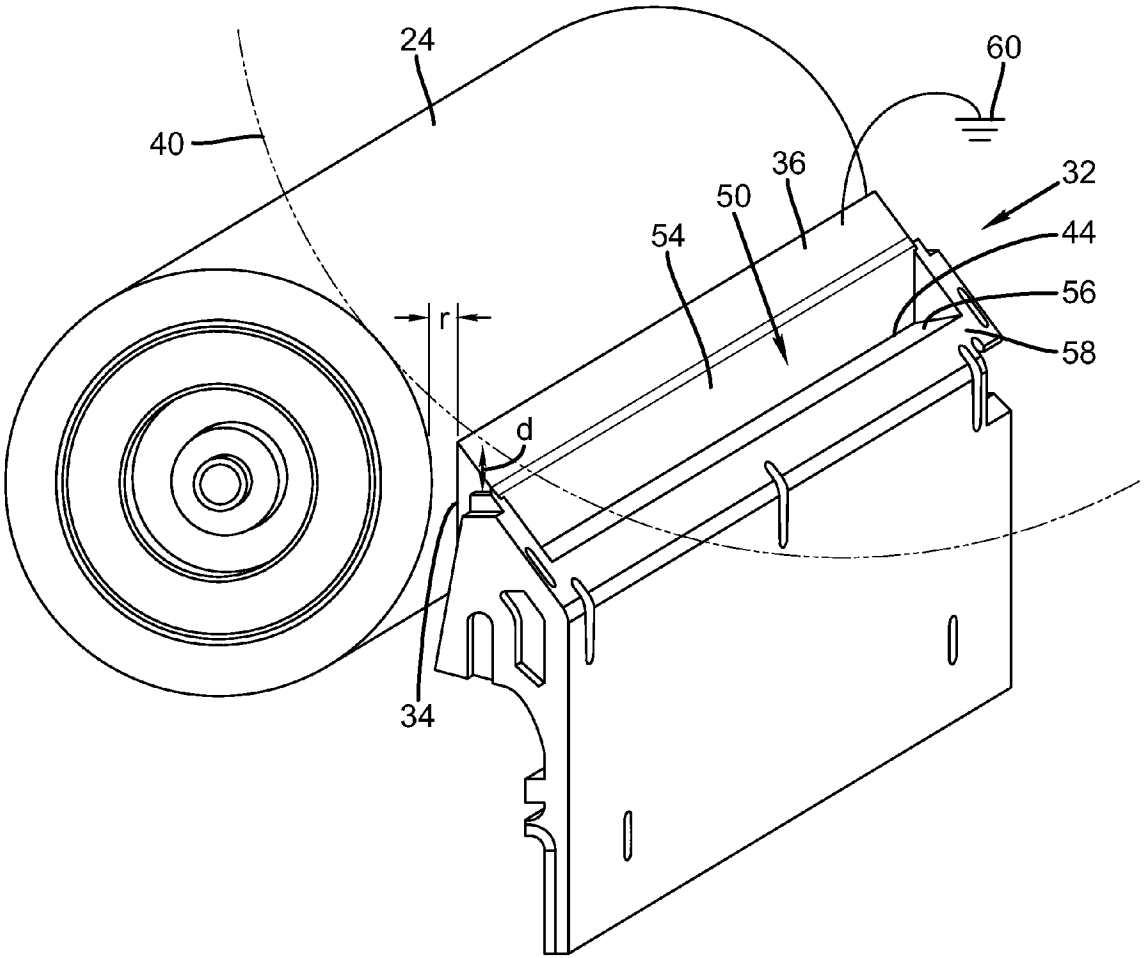
FIG. 3 is a view, in perspective, of the front face of a scavenger plate of FIG. 1.

One embodiment of this invention of the magnetic carrier control device 32 is shown in FIG. 3. The magnetic carrier control device 32 includes a one-piece scavenger plate 34 with the faceplate 36 and the lower plate 44 as one piece. Those skilled the art understand that these could be one or more parts that are electrically conductive or isolative or a combination of the two such that the faceplate 36 interacts with the electric field $F_{FP}$ around the photoconductor surface 40 and the faceplate 36 to preferentially direct magnetic carrier 22 from the photoconductor 38 back toward the faceplate 36. The magnetic field from the development roller 24 directs the magnetic carrier 22 from the faceplate 36 to the development station 10. Any excess magnetic particles of carrier 22 or magnetized toner that is not returned to the development station 10 by the magnetic forces described above are held in the trough 50. This material may be cleaned out later or removed in other manners if necessary.

The lower plate 44 in this embodiment also forms a first side 54 of the trough 50 along with a second portion 56 of the trough 50 adjacent the faceplate 36 such that the surplus magnetic carrier 22 is collected and retained a distance from the photoconductor 38 to prevent pickup by the photoconductor 38 from the lower plate 44 and the trough 50.

A support plate 58 supports the faceplate 36 such that the support plate 58 does not influence the electric field $F_{FP}$ between the photoconductor surface 40 and the faceplate 36 and one or more troughs 50 adjacent the faceplate 36, also known as the face 36. The faceplate 36 of the scavenger plate 34 is positioned parallel to the longitudinal axis of the development roller 24 and the photoconductor surface 40, at a location upstream in the direction of shell rotation prior to the development zone 30.

The factors that apply to the dual component system with the described magnetic carrier control device 32 were developed and tested specifically under the following conditions including preloading the sump with the specified amount of developer. The magnetic carrier control device 32 uses the combination of electric and magnetic fields described above to remove the magnetic carrier 22 from the photoconductor surface 40, and return it to the development station 10. Physically, the magnetic carrier control device 32 acts as a biased electrode 60 that is placed at a distance d (see FIG. 4) from the photoconductor surface 40. The biased electrode 60 of the carrier control device 32 is also placed at some distance from the rotating core magnet 26 of the toning roller 24 in the development station 10 which, under the influence of the magnetic field of the development roller 24, facilitates the return of the magnetic carrier 22 to the development station 10.

Figure 4:
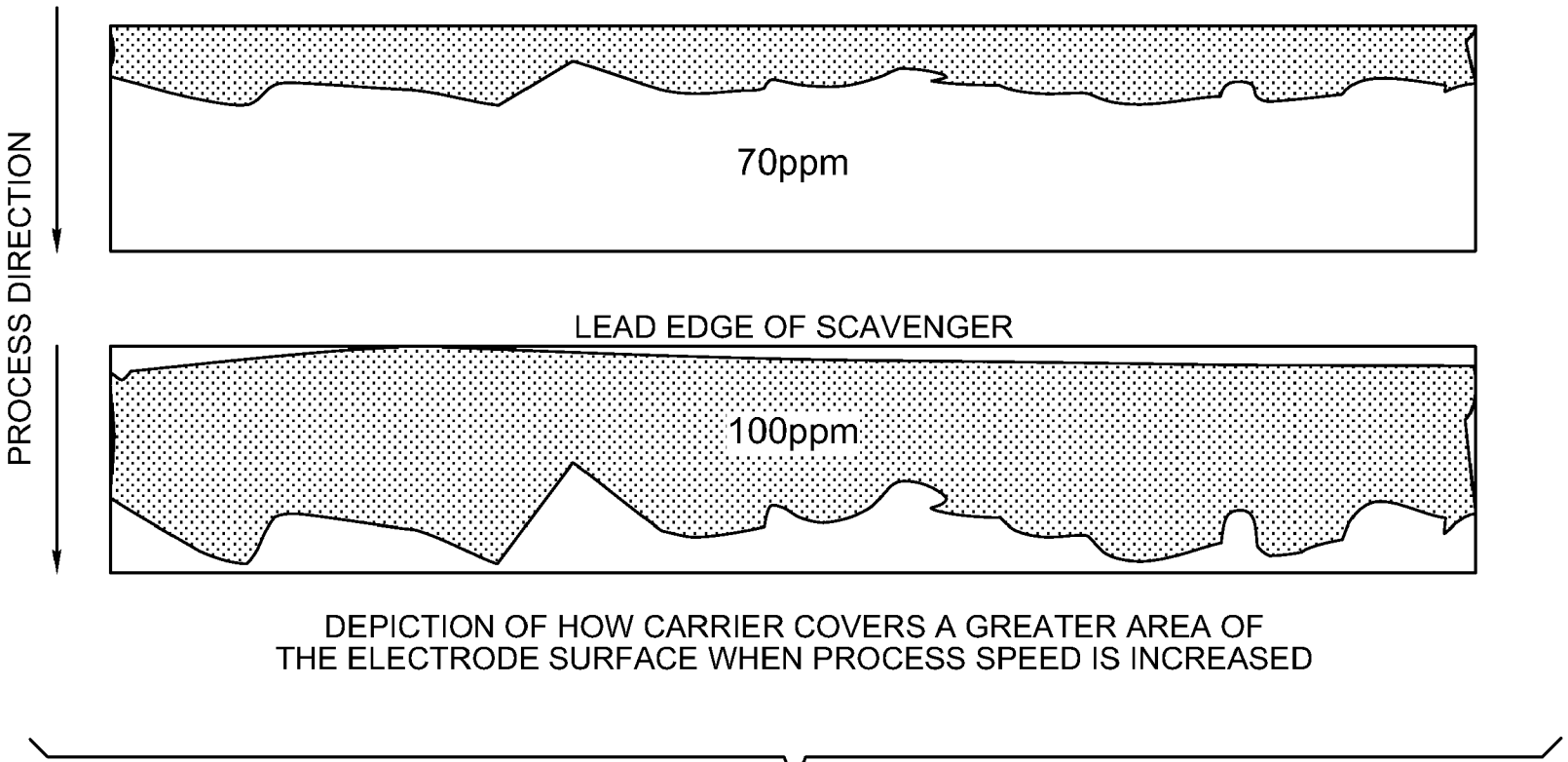
FIG. 4 is a schematic depicting how a carrier covers a greater portion of an electrode surface when a process speed is increased.

In order to prevent the build-up of carrier on the magnetic carrier control device 32 and on the photoconductor 38 the above described magnetic carrier control device 32 was tested by being sped up from the baseline process speed of 70 ppm (300 mm/s) to 100 ppm (428 mm/s). Normally build-up occurs within a short period of time, such as after printing less then 10,000 A4 images, and this build-up interferes with the toned image content. FIG. 4 is a schematic depicting how the carrier covers a greater portion of the electrode surface when the process speed is increased. The described control device and related method prevents this build-up.

In this embodiment the spacing "r" of the electrode to the development roller 24 is approximately equal to the developer nap height and the electrode in this embodiment has a sharp edge so that it can extend into the development nip between the toning roller and the photoconductor. This edge can enhance the electric field of the electrode, which results in improved scavenging of the developer from the image on the photoconductor. Any shape that creates the sharp edge including a plate or a triangular shape could form the sharp point.

This invention was developed based on experimental information that shows the area covered on the face of the magnetic carrier control device 32 electrode by the scavenged magnetic carrier 22 increases as a function of process speed, as shown in FIG. 4. In prior art scavengers when the magnetic carrier 22 landed further away from the electrode the magnetic carrier 22 would buildup around the photoconductor 38 and electrodes. The present invention of the magnetic carrier control device 32 allows any magnetic carrier 22 that lands on or near the magnetic carrier control device 32 to be influenced by the face 36 of the magnetic carrier control device 32 or if the magnetic carrier 22 lands down farther on the magnetic carrier control device 32 to be collected in one or more troughs 50.

In one embodiment the extreme trailing edge of the magnetic carrier control device 32 (as defined by the edge of the magnetic carrier control device 32 farthest from the development roller 24, in the process direction) does not extend any farther than the ability of the toning roller magnetic field to urge the scavenged magnetic carrier 22 back into the development station 15. This for example might be defined as a magnetic field >100 Gauss. The entire face of the face 36 is tangent to the surface of the photoconductor 40 as measured from mid point of the magnetic carrier control device 32 and specifically the face 36 while the extreme leading edge of the magnetic carrier control device 32, as defined by the minimum distance between the leading edge of the magnetic carrier control device 32 and development roller 24, is within a range of 1.27 mm (0.050") less then or equal to the lead edge spacing, such as 1.91 mm (0.075"). In addition the spacing of the scavenger electrode to the photoconductor surface 40 is to be between 0.381 mm (0.015") less then or equal to the magnetic carrier control device 32 to photoconductor spacing such as 0.699 mm (0.0275") and the overall length of the face 36 is between 5.5 mm and 7.0 mm. The magnetic carrier control device 32 also has an integrated space to collect carrier that for whatever reason cannot be returned to the development station 15.

A method to minimize the build up of magnetic carrier 22 includes, during printing operations or between printing step, includes placing the magnetic carrier control device 32, specifically the plates 44 and troughs, 50 such that the influence of the magnetic field of the development roller 24 to move magnetic carrier 22 is minimized. This includes the placement of the magnetic carrier control device 32 such that the extreme trail edge does not extend past the influence of the magnetic field of the development roller 24 to return it to the development station 10.

Figure 5:
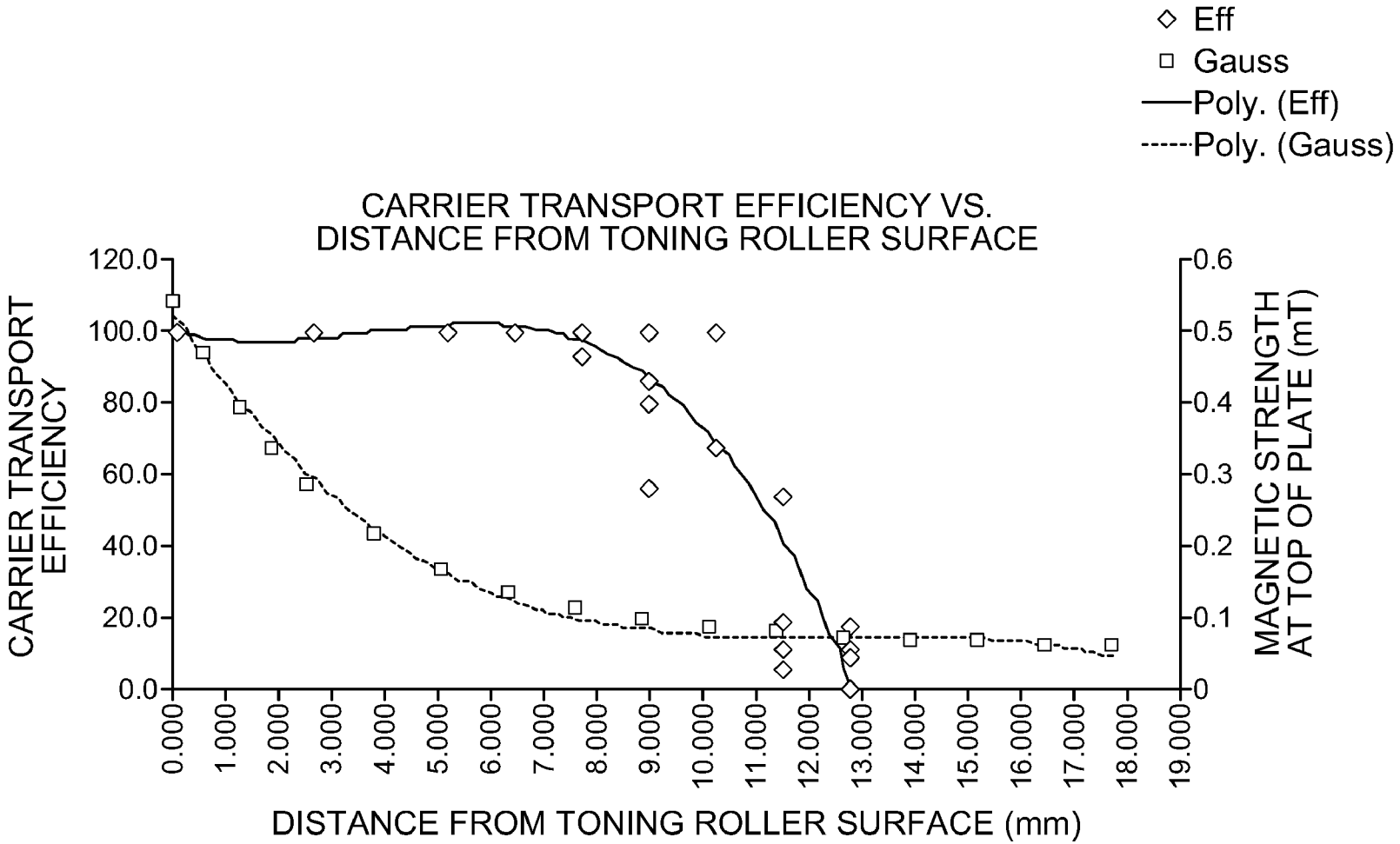
FIG. 5 is a graphic representation of carrier efficiency.

This residual carrier is the analog of the carrier remaining on the face of the magnetic carrier control device 32 after scavenging. This residual was expressed as a percentage of the original carrier load on the movable plate. In one example case, as derived from the graph in FIG. 5 showing carrier efficiency, were the magnetic carrier control device edge is at approximately 7.0 mm from the toning shell and greater, the ability of the magnetic field of the development roller 24 to move the magnetic carrier 22 reduces precipitously. Measurement of the magnetic field by spacing would indicate that as the magnetic field decreases below 100 Gauss, the magnetic field is ineffective at moving carrier, thus more prone to buildup on the electrode of the scavenger. This is the primary influence over where the trail edge of the magnetic carrier control device 32 can be. In other circumstances first determining the photoconductor spacing d and then determining the proper trail edge position for the magnetic carrier control device 32 can determine the spacing d.

Figure 6:
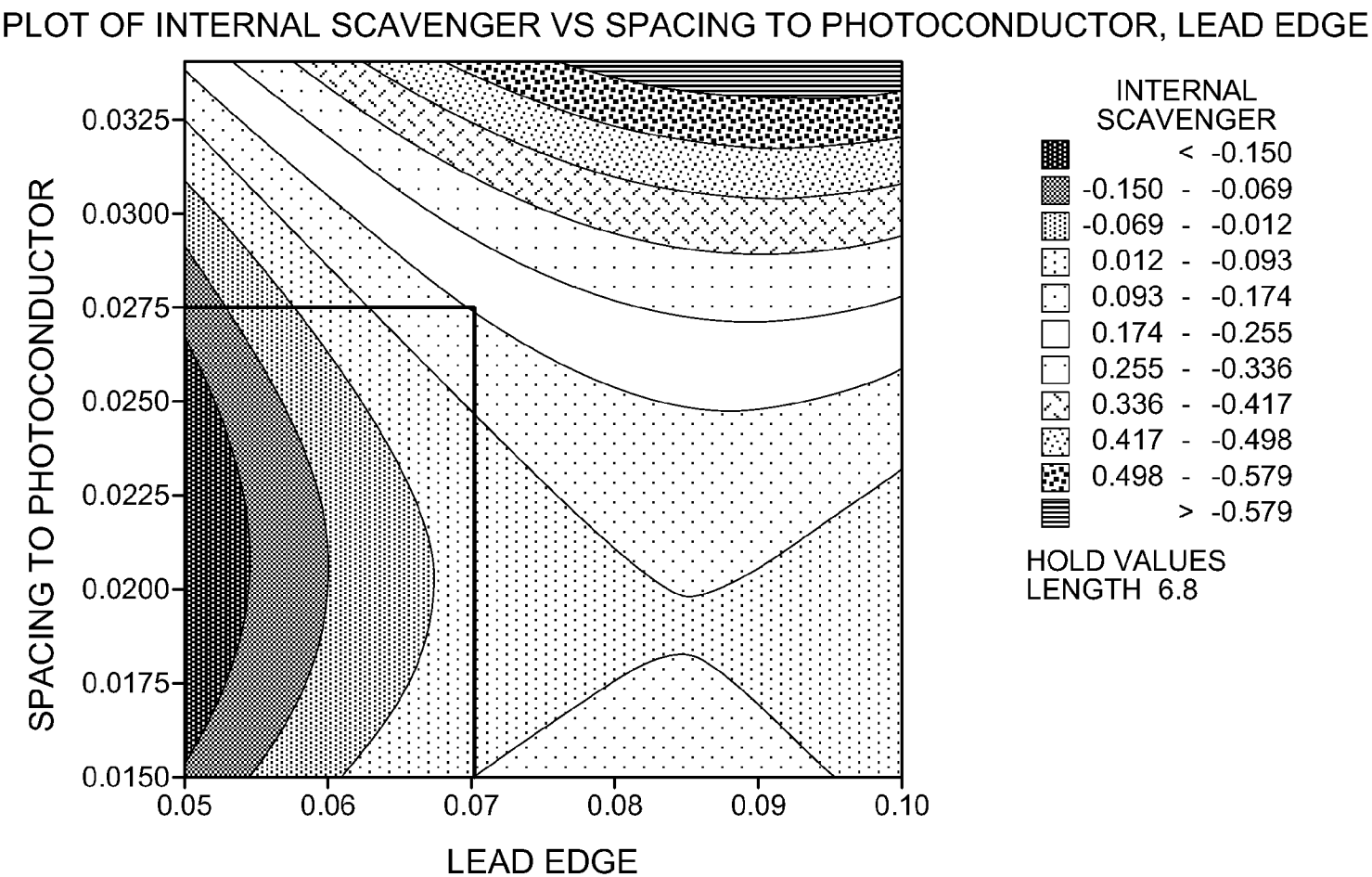
FIG. 6 is a graphic representation of spacing for a magnetic carrier control device.
Figure 7:
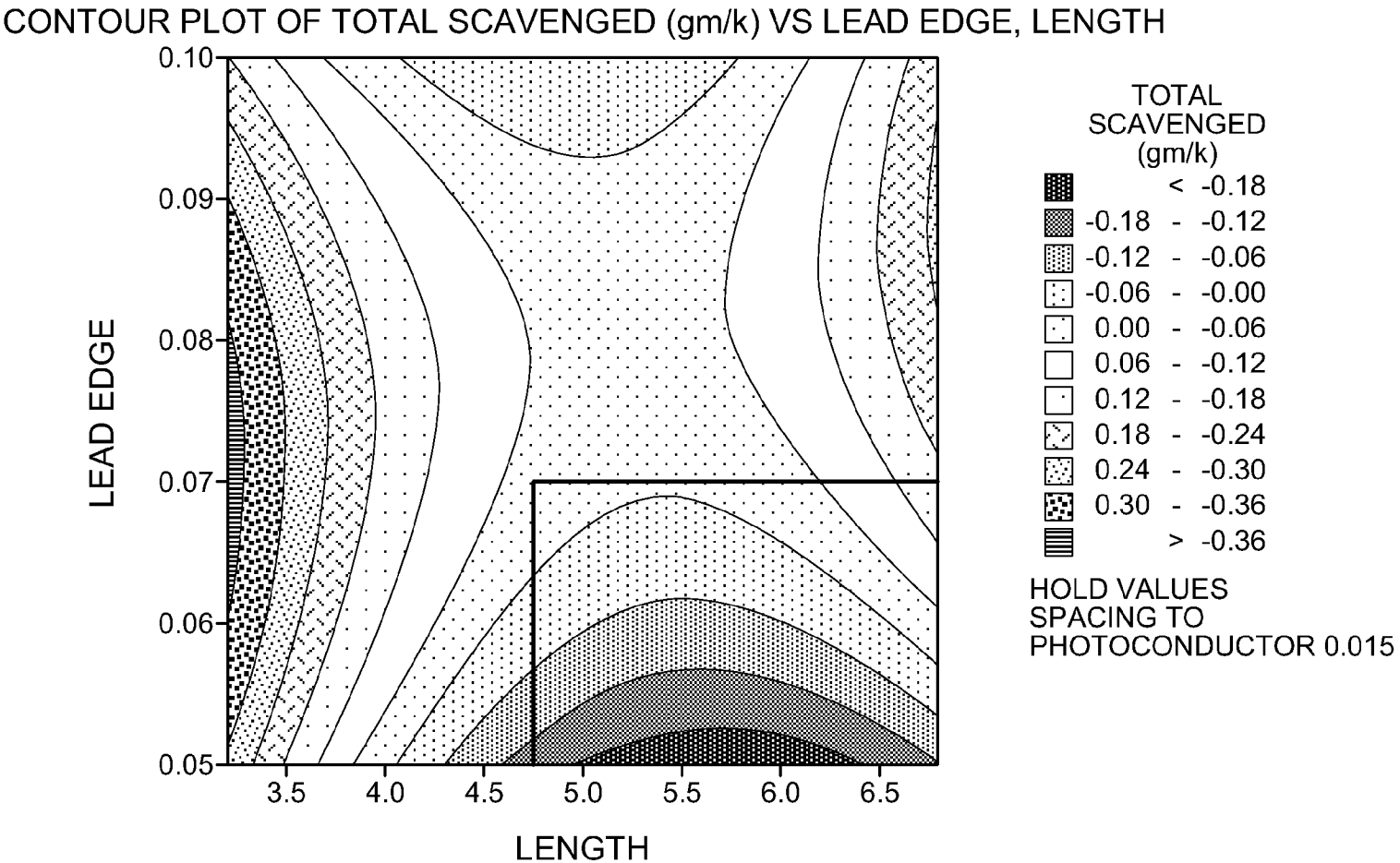
FIG. 7 is a graphic representation of spacing for a magnetic carrier control device of FIG. 1.
Figure 8:
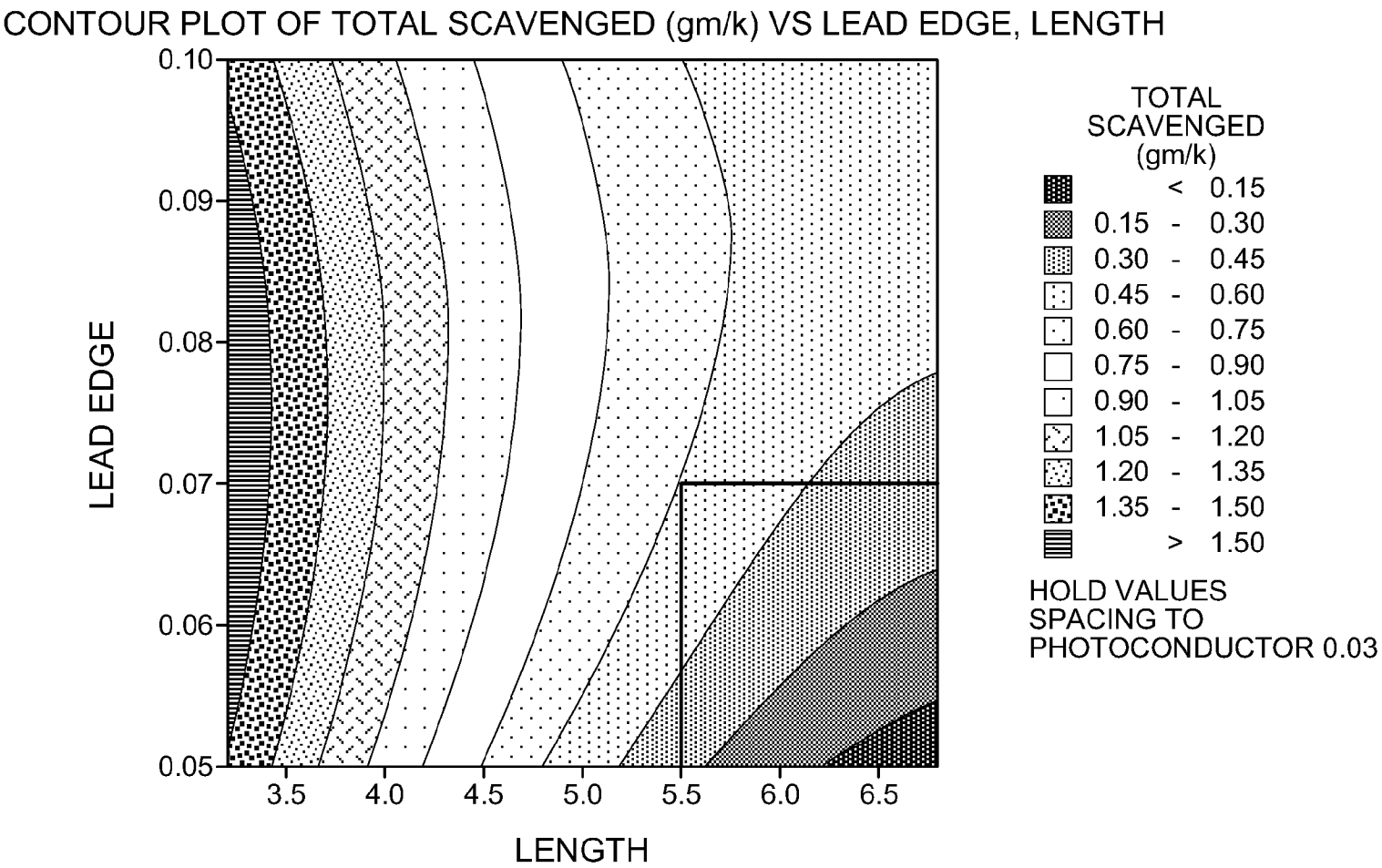
FIG. 8 shows a graphic representation of the present invention.

In FIGS. 6-8 the internal scavenger or face 36 refers to the amount of carrier that is scavenged off of the photoconductor 38 by the face 36, but is not returned to the development station 10. The goal is to have less residue so lead edge spacing that yields a smaller amount of carrier is better, with units of gm/K (gms of carrier per 1000 A4 images). The external scavenger is a reference to the amount of carrier that is collected at a point downstream of the development station 10. This consists of a biased, magnetic bar that collects the carrier that could not be removed off of the photoconductor 38 by the scavenger. carrier per 1000 to yield a total scavenged sum of carrier amounts or the internal scavenger plus the external scavenger, measured with units of gm/K (gms of carrier per 1000 A4 images) with the same units and "smaller is better" preference, shown as a function of lead edge length with a lead edge spacing of 0.015 in FIG. 7 and with a lead edge spacing of 0.030 in FIG. 8.

Figure 9:
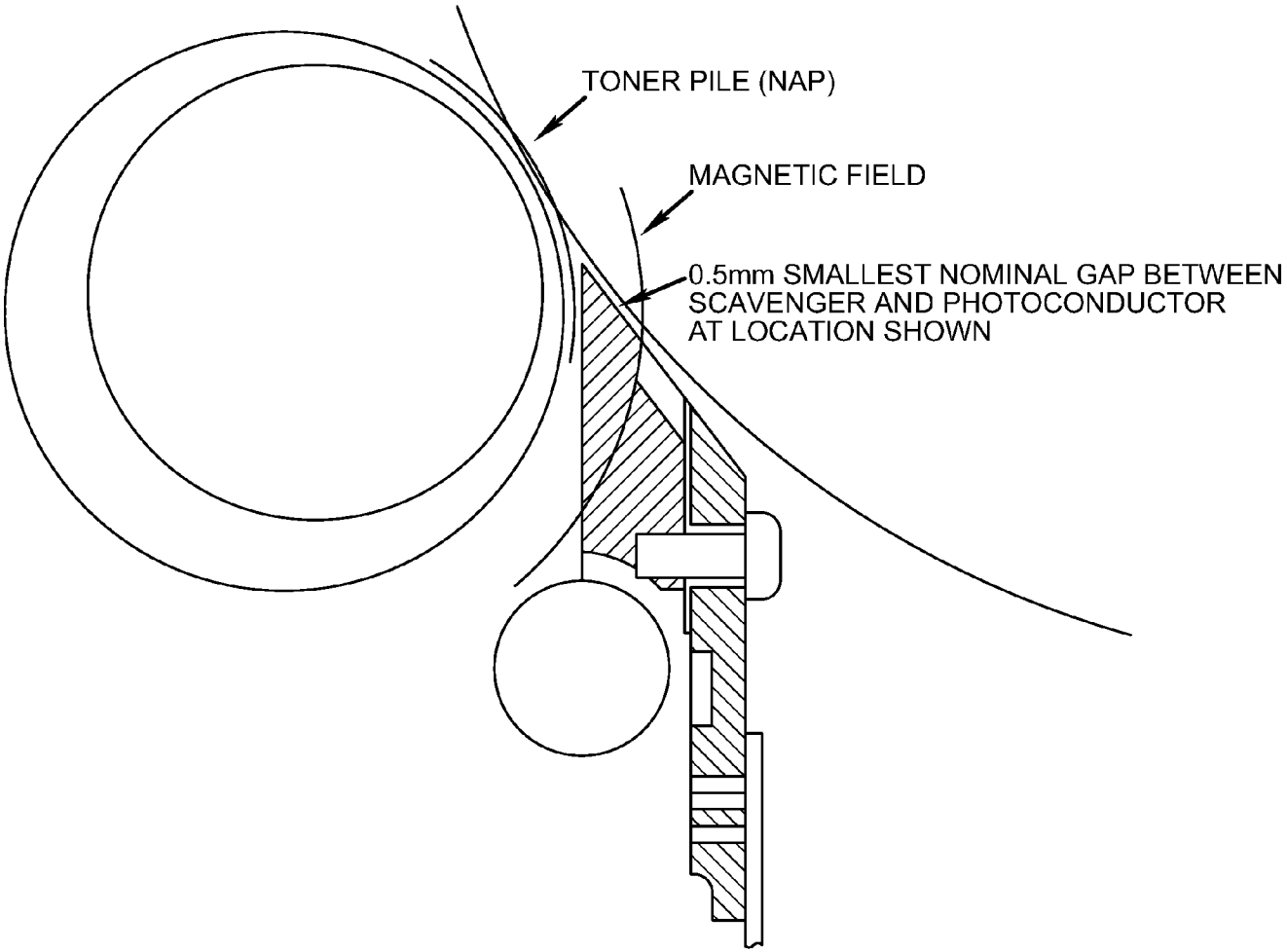
FIG. 9 shows an embodiment of a magnetic carrier control device of FIG. 1.

FIG. 6 shows a contour plot showing relationship between lead edge position of the scavenger, spacing to photoconductor and resulting total scavenged density per unit (DPU). Marked area designated desired region of operation. FIG. 7 shows a contour plot showing relationship between lead edge position of the scavenger, spacing to photoconductor and resulting internal scavenged DPU. The marked area designated desired region of. FIG. 8 shows contour plots of lead edge position and electrode length, spanning the range of desired scavenger to photoconductor spacing, showing the desired area of operation (5.5 mm>=Electrode Length<=7.0 mm). FIG. 9 shows an improved scavenger geometry as discussed above.

The invention has been described in detail with particular reference to certain preferred embodiments thereof but it will be understood that variations and modifications can be effected within the spirit and scope of the invention.

The invention claimed is:

1. A magnetic carrier control apparatus for transporting magnetic carrier comprising:

a. a scavenger plate comprising a face plate to create a magnetic field between a photoconductor and the face plate to preferentially direct magnetic carrier from the photoconductor, back toward a feed apparatus;

b. a support plate for supporting the face plate such that the support plate does not influence the magnetic field between the photoconductor and the face plate; and c. one or more troughs adjacent the face plate such that surplus magnetic carrier is collected and retained away from the photoconductor.

2. The magnetic carrier control apparatus of claim 1, the scavenger plate and the support plate situated such that the plates further comprise a sharp edge.

3. The magnetic carrier control apparatus of claim 2, the sharp edge further extending into the development nip between the toning roller and the photoconductor.

4. The magnetic carrier control apparatus of claim 2, the sharp edge further enhancing an electric field of a scavenger electrode.

5. The magnetic carrier control apparatus of claim 1, further comprising a cleaning mechanism for the troughs to clean toner.

6. The magnetic carrier control apparatus of claim 1, the apparatus, the scavenger plate comprising a faceplate spaced a distance r from the toning roller and a distance d from the photoconductor surface to limit the influence of the support plate on an electric field between the photoconductor surface and the faceplate.

7. The magnetic carrier control apparatus of claim 6, wherein the faceplate width is determined to minimize the influence of the support plate on an electric field between the photoconductor surface and the faceplate.

8. The magnetic carrier control apparatus of claim 6, wherein r is 0.05 inches.

9. A method of transporting magnetic carrier comprising, the method comprising:

a. powering a scavenger plate comprising a face plate by applying an electric current to the face plate to create a magnetic field between a photoconductor and the face plate to preferentially direct magnetic carrier from the photoconductor, back toward the feed apparatus;

b. controlling the electric current to preferentially direct magnetic carrier from the photoconductor, back toward a feed apparatus such that a support plate for supporting the face plate does not influence the magnetic field between the photoconductor and the face plate; and c. cleaning magnetic carrier from one or more troughs adjacent the face plate such that the surplus magnetic carrier is collected and retained away from the photoconductor.

10. The method of claim 9, the method further comprising controlling a spacing between the scavenger plate comprising the faceplate from a toning roller and a photoconductor surface to minimize influence of the support plate on an electric field between the photoconductor surface and the faceplate.

* * * * *